US010806312B2

(12) United States Patent
Hall et al.

(10) Patent No.: US 10,806,312 B2
(45) Date of Patent: Oct. 20, 2020

(54) VACUUM AND BLOWER

(71) Applicant: Hall Labs LLC, Provo, UT (US)

(72) Inventors: David R. Hall, Provo, UT (US); Jerome Miles, Spanish Fork, UT (US); Casey Webb, Spanish Fork, UT (US)

(73) Assignee: Hall Labs LLC, Provo, UT (US)

( * ) Notice: Subject to any disclaimer, the term of this patent is extended or adjusted under 35 U.S.C. 154(b) by 218 days.

(21) Appl. No.: 16/102,369

(22) Filed: Aug. 13, 2018

(65) Prior Publication Data

US 2020/0046181 A1 Feb. 13, 2020

(51) Int. Cl.

| | |
|---|---|
| ***A47L 5/14*** | (2006.01) |
| *A47L 9/00* | (2006.01) |
| *A47L 5/24* | (2006.01) |
| *A47L 9/28* | (2006.01) |

(52) U.S. Cl.

CPC . *A47L 5/14* (2013.01); *A47L 5/24* (2013.01); *A47L 9/0018* (2013.01); *A47L 9/2842* (2013.01)

(58) Field of Classification Search

CPC . A47L 5/14; A47L 5/24; A47L 9/0018; A47L 9/2842

See application file for complete search history.

(56) References Cited

U.S. PATENT DOCUMENTS 4,718,140 A * 1/1988 Johnson ..... A47L 5/24 15/330
5,392,490 A * 2/1995 Monson ..... A47L 5/24 15/320
5,477,585 A * 12/1995 Hentzschel ..... A47L 5/14 15/330
5,926,909 A * 7/1999 McGee ..... A47L 5/24 15/339
5,970,572 A * 10/1999 Thomas ..... A47L 5/24 15/320
6,735,813 B2 * 5/2004 Oohama ..... A47L 5/14 15/327.5
2002/0108207 A1 * 8/2002 Oohama ..... A47L 5/14 15/330

(Continued)

FOREIGN PATENT DOCUMENTS

CN 201422832 Y * 3/2010
CN 104367265 A * 2/2015
EP 0821872 A2 * 2/1998 ..... A47L 5/14

OTHER PUBLICATIONS

CN-201422832-Y—English Machine Translation (Year: 2010).*

*Primary Examiner* — Marc Carlson

(57) ABSTRACT

A vacuum and blower device is disclosed. The vacuum and blower device comprises a fan driven by a first motor, and a housing with a vent, a vacuum input aperture, and a blower output aperture. The vacuum input aperture and the blower output aperture are on one end of the device. The vacuum and blower device further includes an airflow director, the airflow director being held within the housing and adapted to be rotated between a first and second position. A blower output channel communicates with the airflow director and the blower output aperture. In the first position, the fan draws air through the vacuum input aperture and out the vent and airflow to the blower output channel is blocked. In the second position, the fan blows air through the blower output channel and out the blower output aperture.

19 Claims, 7 Drawing Sheets

(56) References Cited

U.S. PATENT DOCUMENTS

| | | | | |
|---|---|---|---|---|
| 2008/0307602 | A1* | 12/2008 | Andriolo | E01H 1/0809 15/330 |
| 2017/0202413 | A1* | 7/2017 | Tan | A47L 5/14 |
| 2017/0202414 | A1* | 7/2017 | Wang | A47L 9/325 |
| 2017/0371341 | A1* | 12/2017 | Leinhos | A47L 11/4011 |
| 2019/0167059 | A1* | 6/2019 | Brown | G05D 1/0033 |

* cited by examiner

VACUUM AND BLOWER

TECHNICAL FIELD

This invention relates generally to vacuum-blower apparatus.

BACKGROUND

Convertible vacuum/blower devices are commonly used by both homeowners and professionals. These devices may be configured for use as either a vacuum or blower to pick up or blow away debris. Typical uses include removal and displacement of debris from lawns, sidewalks, roads, streets, etc. The standard convertible vacuum/blower device often requires a physical reconfiguration of the device to change its function. While functioning as a blower, an elongated tube may be secured to the airflow outlet, allowing the user to control direction of airflow. While functioning as a vacuum, an elongated tube may be secured to the airflow inlet, while a debris collection container may be secured to the airflow outlet. It can be difficult and tedious for a user to attach and detach various parts of the device and to carry unused parts Some solutions to this problem have been presented. One includes the use of multiple fans, each fan corresponding to a direction of airflow. Another includes rotating a single fan 180° to change direction of airflow. These solutions still have drawbacks. The use of multiple fans can require extra technology and controls, as well as extra space in the device for the second fan. Rotating a single fan can also require extra space and may still require a physical reconfiguration by the user.

SUMMARY

In a first aspect, the disclosure provides a vacuum and blower device. The vacuum and blower device comprises a fan driven by a first motor, and a housing with a vent, a vacuum input aperture, and a blower output aperture. The vacuum input aperture and the blower output aperture are on one end of the device. The vacuum and blower device further includes an airflow director, the airflow director being held within the housing and adapted to be rotated between a first and second position. A blower output channel communicates with the airflow director and the blower output aperture. In the first position, the fan draws air through the vacuum input aperture and out the vent and airflow to the blower output channel is blocked. In the second position, the fan blows air through the blower output channel and out the blower output aperture.

Further aspects and embodiments are provided in the foregoing drawings, detailed description and claims.

BRIEF DESCRIPTION OF THE DRAWINGS

The following drawings are provided to illustrate certain embodiments described herein. The drawings are merely illustrative and are not intended to limit the scope of claimed inventions and are not intended to show every potential feature or embodiment of the claimed inventions. The drawings are not necessarily drawn to scale; in some instances, certain elements of the drawing may be enlarged with respect to other elements of the drawing for purposes of illustration.

DETAILED DESCRIPTION

The following description recites various aspects and embodiments of the inventions disclosed herein. No particular embodiment is intended to define the scope of the invention. Rather, the embodiments provide non-limiting examples of various compositions, and methods that are included within the scope of the claimed inventions. The description is to be read from the perspective of one of ordinary skill in the art. Therefore, information that is well known to the ordinarily skilled artisan is not necessarily included.

Definitions

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a substituent" encompasses a single substituent as well as two or more substituents, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

Figure 1:
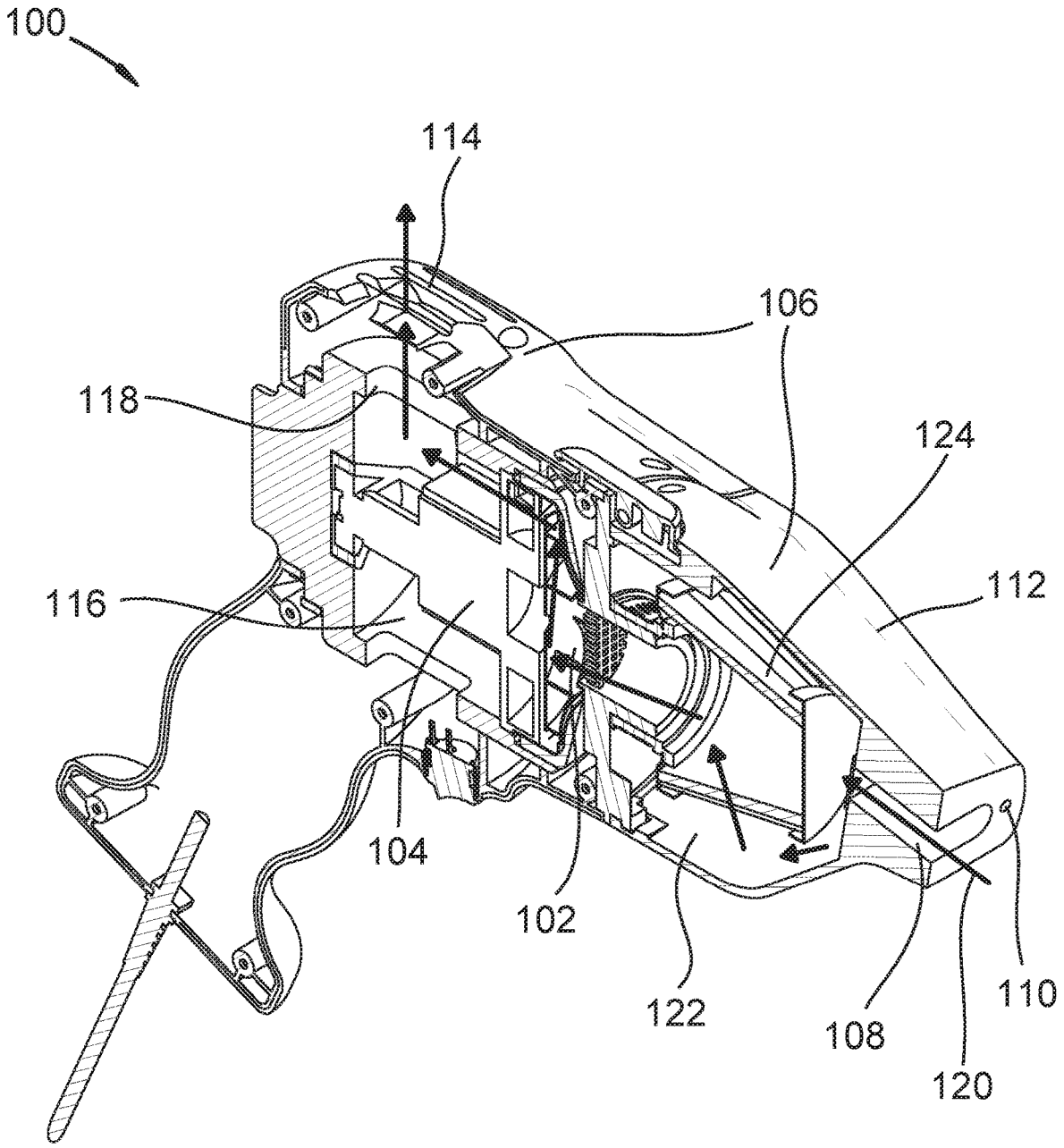
FIG. 1 is a cutaway angled side view of a vacuum and blower device in vacuum mode.

Now referring to FIG. 1, a cutaway angled side view of a vacuum and blower device in vacuum mode is shown at 100, according to one embodiment of the present invention. The vacuum and blower device includes fan 102 driven by first motor 104, housing 106 with vacuum input aperture 108 and blower output aperture 110, blower output channel 112, vent 114, and airflow director 116 with opening 118. Housing 106 has chamber 122, which holds filter 124. Airflow director 116 is adapted to rotate between a first and second position. Fan 102 and airflow director 116 rotate about the same axis. Blower output channel 112 communicates via opening 118 with airflow director 116 and blower output aperture 110. Airflow director 116 is in the first position. Air follows airflow path 120 as the airflow director is in the first position. Fan 102 draws air through vacuum input aperture 108, through opening 118, and out vent 114. Airflow to blower output channel 112 is blocked. As air flows through the vacuum and blower device, debris drawn through vacuum input aperture 108 is captured in chamber 122.

Figure 2:
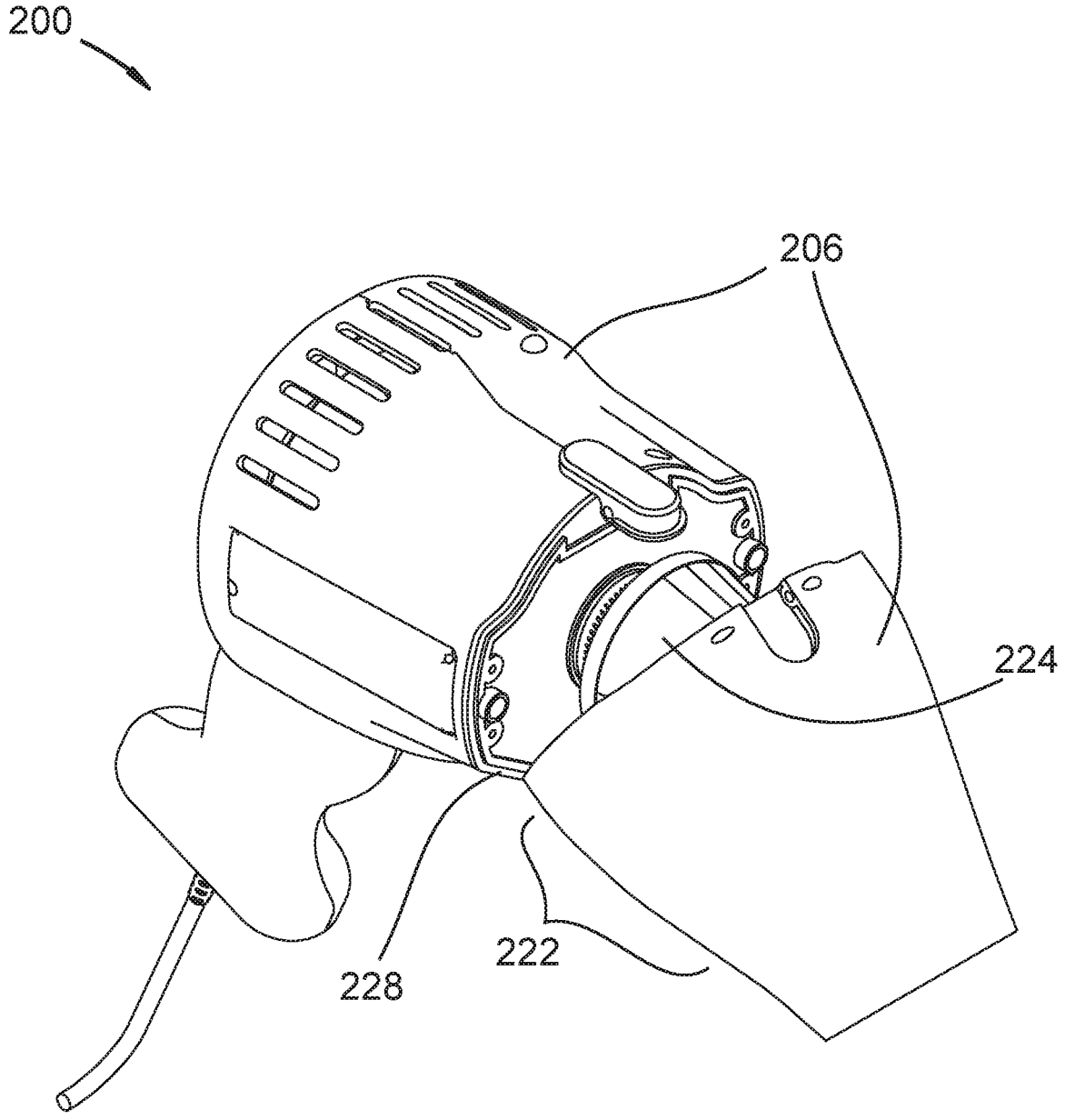
FIG. 2 is an isometric angled side view of a vacuum and blower device with the device housing opened to remove debris.

Referring to FIG. 2, an isometric angled side view of vacuum and blower device 100, of FIG. 1, is shown at 200, according to one embodiment of the present invention. The vacuum and blower device includes housing 206. Housing 206 has chamber 222, which holds filter 224. Housing 206 is opened at 228, such that a user may remove debris and liquid caught in chamber 222. In some embodiments, housing 206 may separate into one or more pieces to enable removal of debris and liquid. In some embodiments, filter 224 may be removed from the device such that a user may clear filter 224 of debris and liquid and replace filter 224.

Figure 3A:
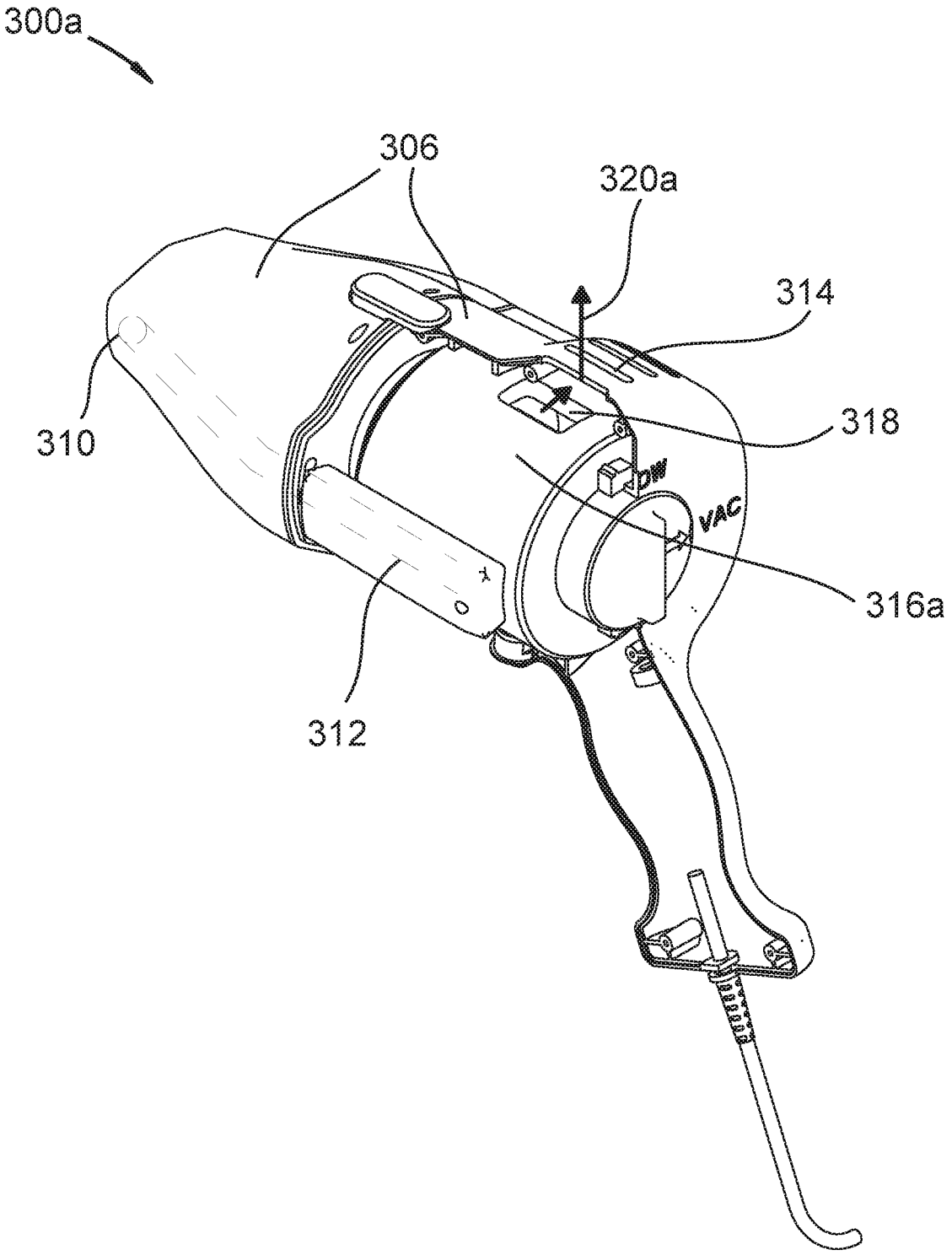
FIG. 3*a* is a partially cutaway angled side view of a vacuum and blower device in vacuum mode.

Referring to FIG. 3*a*, a partially cutaway angled side view of a vacuum and blower device in vacuum mode is shown at 300*a*. The vacuum and blower device includes a fan driven by a first motor, housing 306 with a vacuum input aperture and blower output aperture 310, blower output channel 312, vent 314, and an airflow director with opening 318*a*. The airflow director is adapted to rotate between a first and second position. The fan and the airflow director rotate about the same axis. Blower output channel 312 communicates with the airflow director and blower output aperture 310. The airflow director is in the first position. Air follows airflow path 320*a* as the airflow director is in the first position. The fan draws air through the vacuum input aperture, through opening 318*a* on the airflow director, and out vent 314. Airflow to blower output channel 312 is blocked.

Figure 3B:
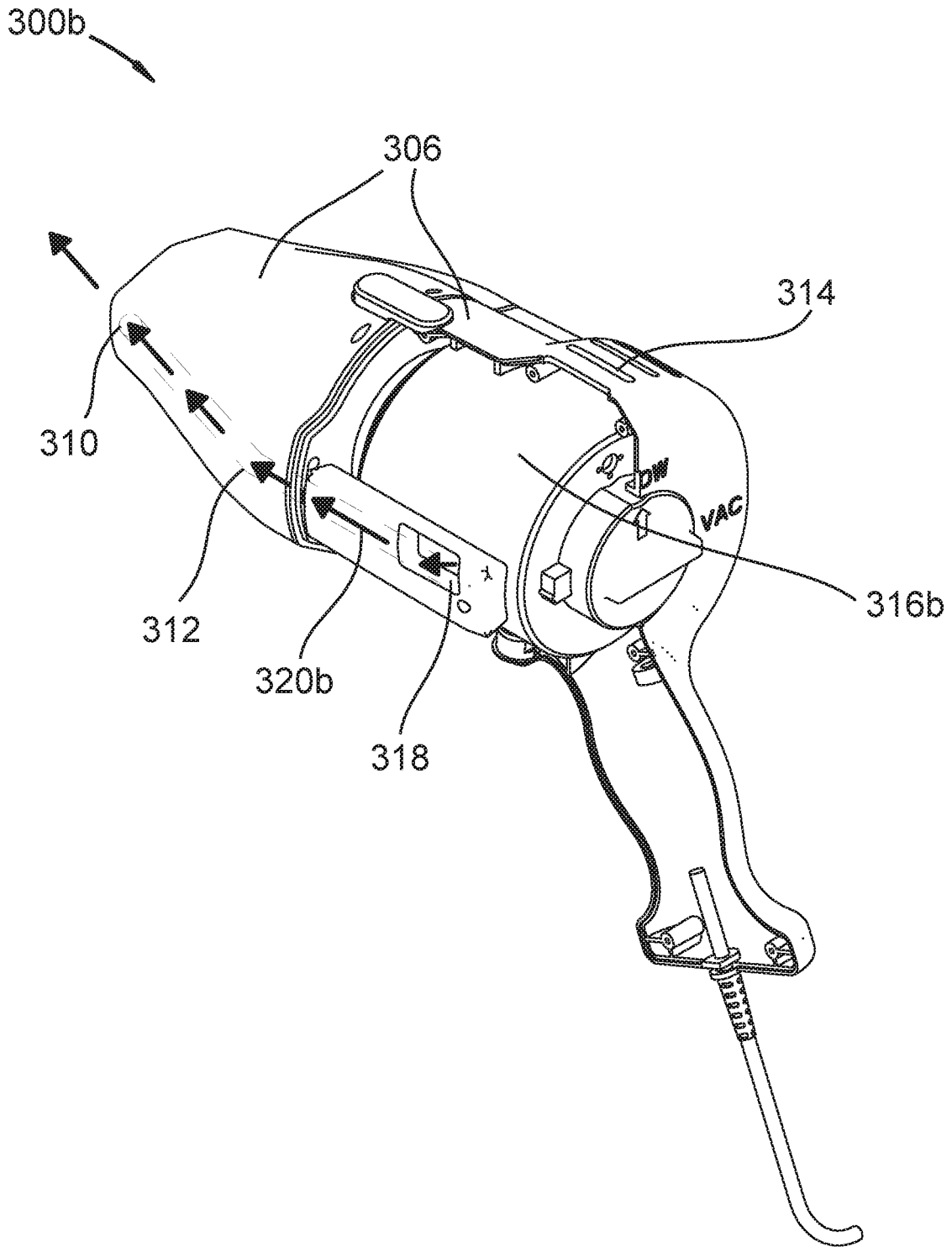
FIG. 3*b* is a partially cutaway angled side view of a vacuum and blower device in blower mode.

Referring to FIG. 3*b*, a partially cutaway angled side view of a vacuum and blower device in blower mode is shown at 300*b*. The vacuum and blower device includes a fan driven by a first motor, housing 306 with a vacuum input aperture and blower output aperture 310, blower output channel 312, vent 314, and an airflow director with opening 318*b*. The airflow director is adapted to rotate between a first and second position. The fan and the airflow director rotate about the same axis. Blower output channel 312 communicates with the airflow director and blower output aperture 310. The airflow director is in the second position. Air follows airflow path 320*b* as the airflow director is in the second position. The fan draws air through the vacuum input aperture, through opening 318*b* on the airflow director, through blower output channel 312 and out blower output aperture 310. Airflow to vent 314 is blocked.

Figure 4:
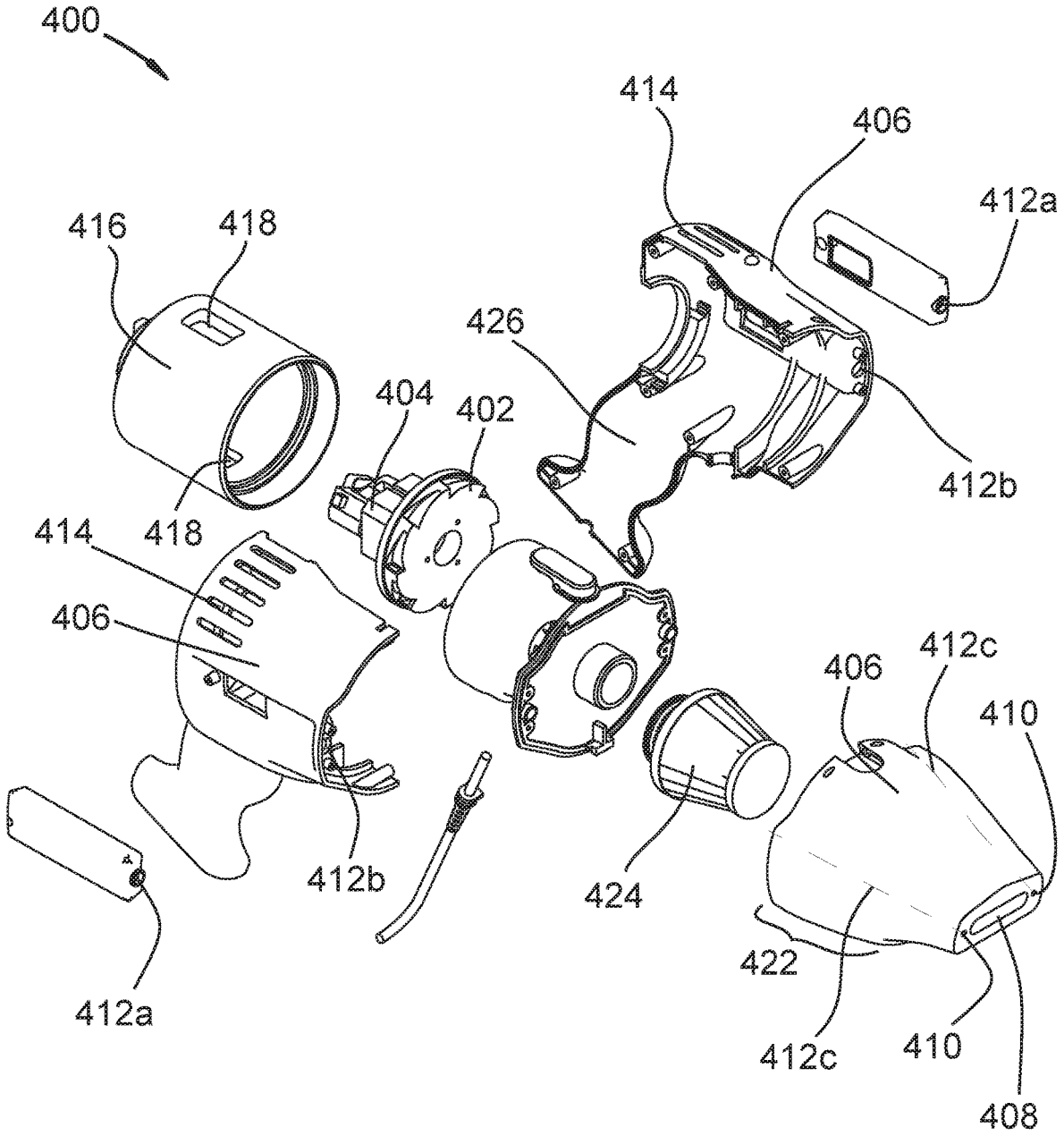
FIG. 4 is an exploded angled side view of a vacuum and blower device.

Referring to FIG. 4, an exploded angled side view of a vacuum and blower device is shown at 400, according to one embodiment of the present invention. The vacuum and blower device includes fan 402 driven by first motor 404, housing 406 with vacuum input aperture 408 and blower output apertures 410, blower output channels extending through the housing as shown at 412*a*, 412*b*, and 412*c*, vent 414, and airflow director 416 with openings 418. Housing 406 has chamber 422, which holds filter 424, and handle 426. Airflow director 416 is adapted to rotate between a first and second position. Fan 402 and airflow director 416 rotate about the same axis. Blower output channels 412*a-c* communicate via openings 418 with airflow director 416 and blower output apertures 410. Airflow director 416 is in the first position. In the first position, fan 402 draws air through vacuum input aperture 408 and out vent 414 via openings 318 and airflow to blower output channels 412*a-c* is blocked. In the second position, fan 402 draws air through vacuum input aperture 408 and through openings 418 to blower output channels 412*a-c* and out blower output apertures 410. As air flows through the vacuum and blower device, debris drawn through vacuum input aperture 408 is captured in chamber 422. The vacuum and blower device includes control electronics that control functions of the vacuum and blower and a controller that controls access to a power source for the vacuum and blower device. The control electronics and controller are contained within handle 426.

Figure 5:
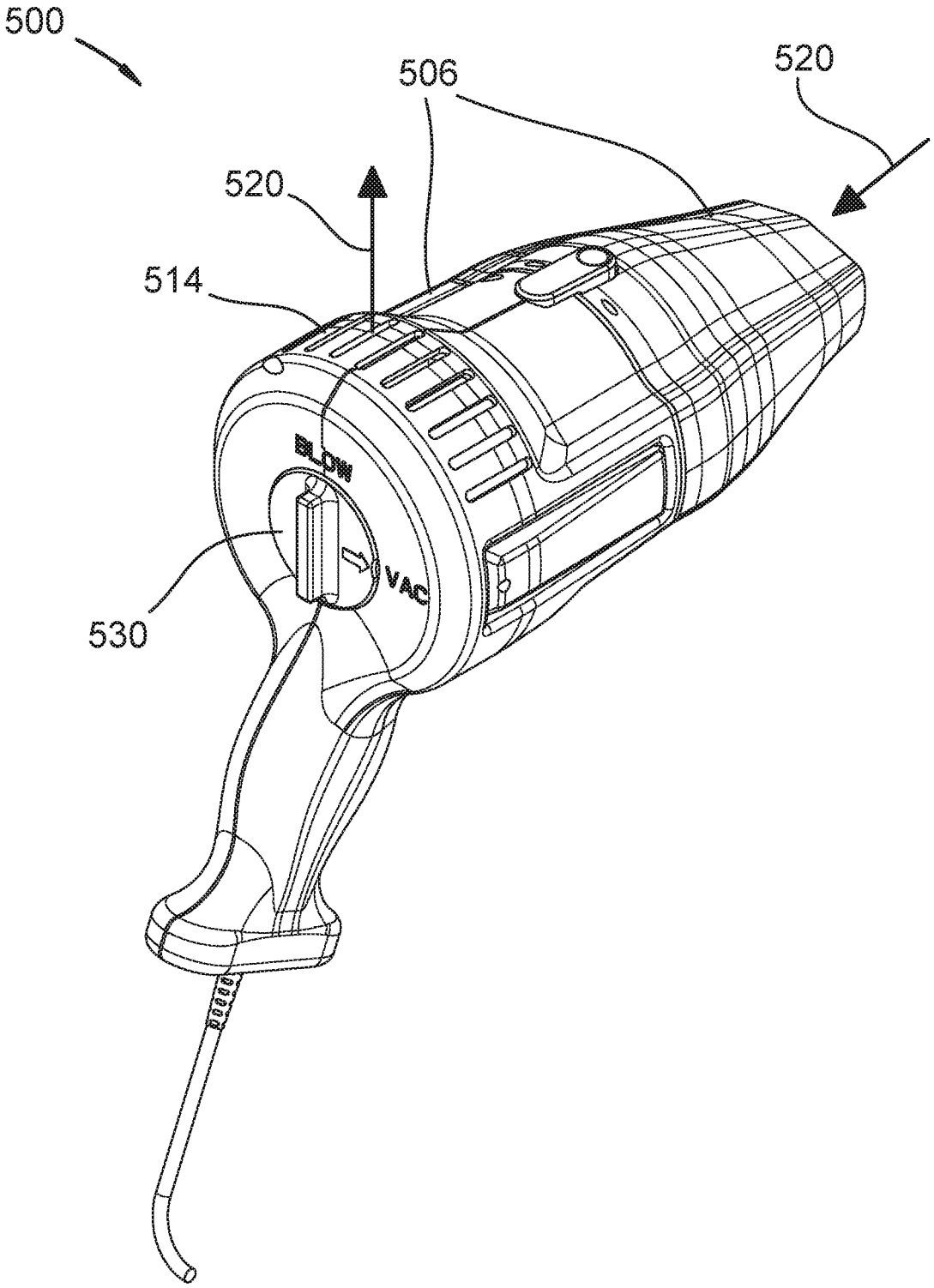
FIG. 5 is an isometric angled back view of a vacuum and blower device in vacuum mode.

Referring to FIG. 5, an isometric angled back view of a vacuum and blower device in vacuum mode is shown at 500, according to one embodiment of the present invention. The vacuum and blower device includes a fan driven by a first motor, housing 506 with a vacuum input aperture and a blower output aperture, a blower output channel, vent 514, and an airflow director. The airflow director is adapted to rotate between a first and second position. Knob 530 rotates the airflow director. A user may rotate knob 530 to rotate the airflow director between the first and second positions. The airflow director is in the first position, which corresponds to vacuum mode. In the first position, the fan draws air through the vacuum input aperture and out through vent 514 and airflow to the blower output channel is blocked as shown at 520. In the second position, the fan draws air through the vacuum input aperture and out through the blower output channels and blower output aperture.

Figure 6:
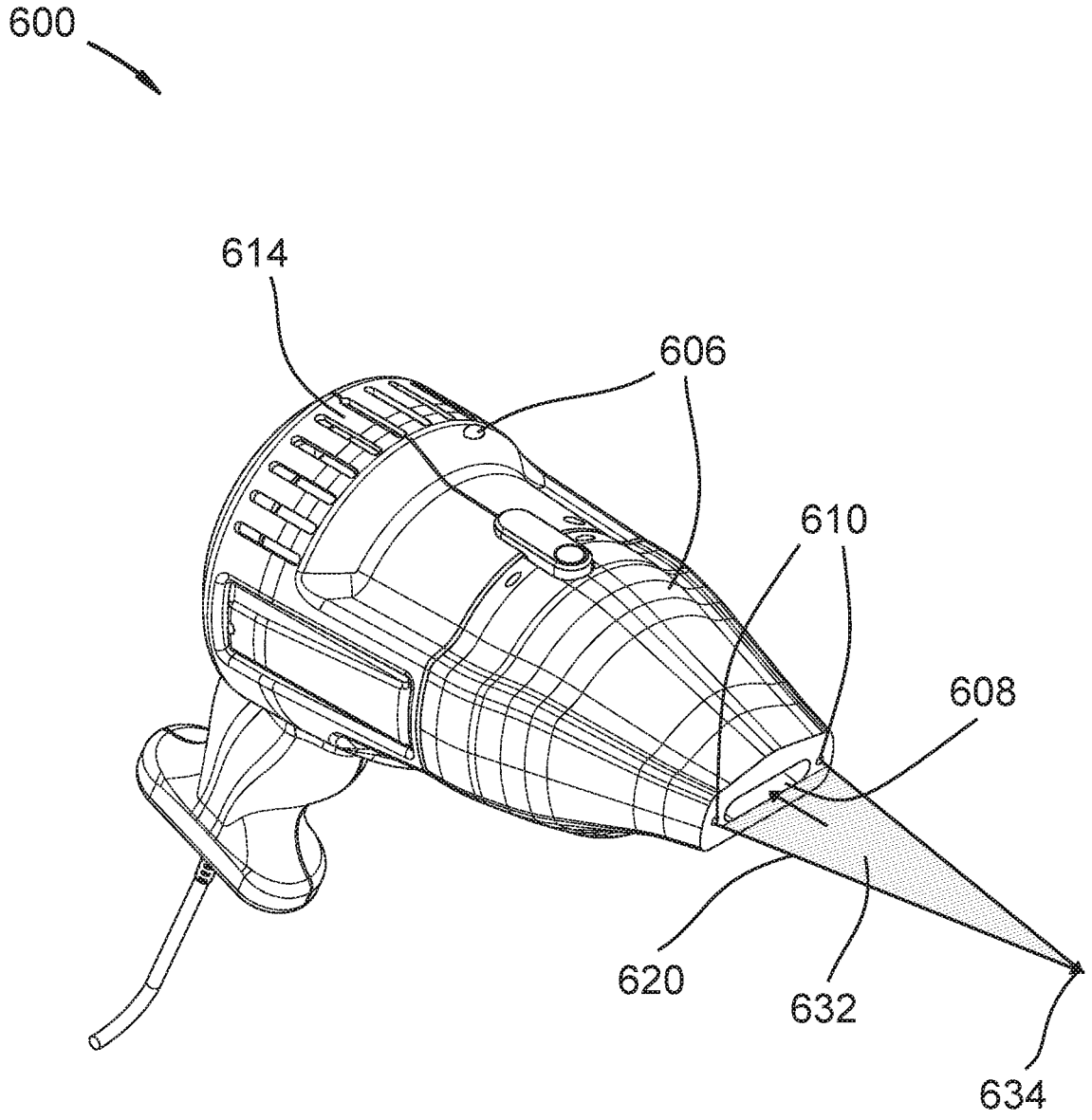
FIG. 6 is an isometric angled side view of a vacuum and blower device in blower mode.

Referring to FIG. 6, an isometric angled side view of a vacuum and blower device in blower mode is shown at 600, according to one embodiment of the present invention. The vacuum and blower device includes a fan driven by a first motor, housing 606 with vacuum input aperture 608 and blower output apertures 610, blower output channels, vent 614, and an airflow director. The airflow director is adapted to rotate between a first and second position. The airflow director is in the second position, which corresponds to blower mode. In the first position, the fan draws air through vacuum input aperture 608 and out through vent 614 and airflow to the blower output channel is blocked. In the second position, the fan draws air through vacuum input aperture 608 from space 632 outside of the vacuum and blower device. The airflow director directs air out through the blower output channels and blower output apertures 610 to area 634 as shown at 620. Preferably, the cross-sectional area of blower output apertures 610 is less than that of vacuum input aperture 608, resulting in higher air velocity at the blower output aperture. Area 634 lies outside of space 632. Preferably, the space extends a minimum of 0.5 inches from the blower output aperture and vacuum input aperture, the area being directly outside of the space. More preferably, area 634 is at a distance greater than 0.5 inches away from the vacuum input aperture.

In some embodiments, the vacuum and blower device may comprise a second motor. The second motor may rotate the airflow director between the first and second positions.

In some embodiments, the device is configured to draw in liquids. In particular, the negative pressure created by the fan as the airflow director is in the first position may draw liquid through the vacuum input aperture. Liquid may be collected in the chamber. In some embodiments, the vacuum and blower device includes a fluid flow detector. As the fluid flow detector detects a level of fluid, the motor may stop running.

In some embodiments, the power source comprises a battery. The battery may be contained within the handle. The battery may provide peak load power to the vacuum and blower device as needed. The battery may contribute to the device start up power. The battery may be rechargeable. In some embodiments, the controller stores a duty cycle of the vacuum and blower device. In some embodiments, the controller stores a power consumption limit of the vacuum and blower device.

In some embodiments, the vacuum and blower device is adapted to communicate with one or more disparate devices. The one or more disparate devices may include a remote device. Preferably, the remote device is a device that provides a user interface, where the user can at least see current settings for the vacuum and blower device. More preferably, the remote device provides a user interface, where the user can see the current settings and provide instructions to the vacuum and blower device to control functions.

The invention has been described with reference to various specific and preferred embodiments and techniques. Nevertheless, it is understood that many variations and modifications may be made while remaining within the spirit and scope of the invention.

What is claimed is:

1. A vacuum and blower device comprising:

a fan driven by a first motor;

a housing with a vent, a vacuum input aperture, and a blower output aperture, wherein the vacuum input aperture and the blower output aperture are on one end of the device;

an airflow director held within the housing and adapted to be rotated between a first position and second position; and a blower output channel communicating with the airflow director and the blower output aperture;

wherein the fan and the airflow director rotate about the same axis;

wherein, in the first position, the fan draws air through the vacuum input aperture and out the vent and airflow to the blower output channel is blocked; and wherein, in the second position, the fan blows air through the blower output channel and out the blower output aperture.

2. The invention of claim 1 further comprising a second motor, the second motor rotating the airflow director.

3. The invention of claim 1, wherein, in the second position, the fan draws air through the vacuum input aperture and out through the blower output channel and the blower output aperture.

4. The invention of claim 2, wherein the fan draws air through the vacuum input aperture from a space outside of the device and directs air out through the blower output channel and the blower output aperture to an area outside of the space.

5. The invention of claim 1 further comprising a filter and a chamber between the vacuum input aperture and the fan, such that debris drawn through the vacuum input aperture is captured in the chamber.

6. The invention of claim 5, wherein, in the first position, negative pressure created by the fan draws liquid through the vacuum input aperture and liquid is collected in the chamber.

7. The invention of claim 6, wherein the housing may be opened to gain access to the chamber such that debris and liquid caught in the chamber may be removed.

8. The invention of claim 7, further comprising a fluid flow detector, wherein when the fluid flow detector detects a level of fluid, the first motor stops running.

9. The invention of claim 1, wherein the vacuum and blower device are adapted to communicate with one or more disparate devices.

10. The invention of claim 9, wherein the one or more disparate devices comprises a remote device.

11. The invention of claim 10, wherein the remote device comprises a smart device running an app.

12. The invention of claim 11, further comprising control electronics that control functions of the vacuum and blower and a controller that controls access to a power source for the vacuum and blower device.

13. The invention of claim 12, wherein the power source comprises a battery.

14. The invention of claim 13, wherein the controller stores a duty cycle of the vacuum and blower device.

15. The invention of claim 14, wherein the controller also stores a power consumption limit for the vacuum and blower device.

16. A vacuum and blower device comprising:

a fan driven by a first motor;

a housing with a vent, a vacuum input aperture and a blower output aperture, wherein the vacuum input aperture and the blower output aperture are on one end of the device;

a chamber and a filter between the vacuum input aperture and the fan, wherein the housing may be opened to gain access to the chamber;

an airflow director held within the housing and adapted to be rotated between a first position and second position;

an axis, such that the fan and the airflow director rotate about the axis;

a blower output channel communicating with the airflow director and the blower output aperture;

control electronics that control functions of the vacuum and blower;

a controller that controls access to a power source for the device, wherein the controller also stores a duty cycle and a power consumption limit for the device;

wherein, in the first position, the fan draws air through the vacuum input aperture from a space outside of the device and out the vent and airflow to the blower output channel is blocked, and negative pressure created by the fan draws liquid and debris through the vacuum input aperture such that the liquid and debris are collected in the chamber;

wherein, in the second position, the fan draws air through the vacuum input aperture from the space outside of the device and out through the blower output channel and the blower output aperture to an area outside of the space; and wherein the device is adapted to communicate with one or more disparate devices.

17. The invention of claim 16 further comprising a second motor, the second motor rotating the airflow director.

18. The invention of claim 16, further comprising a fluid flow detector, wherein when the fluid flow detector detects a level of fluid, the first motor stops running.

19. The invention of claim 16, wherein the one or more disparate devices comprises a smart device running an app.

* * * * *